US011674245B2

(12) United States Patent
Weber et al.

(10) Patent No.: US 11,674,245 B2
(45) Date of Patent: Jun. 13, 2023

(54) BRAIDED ELECTRONIC DEVICE CABLE, BRAIDING MACHINE AND METHOD FOR BRAIDING AN ELECTRONIC DEVICE CABLE

(71) Applicant: Apple Inc., Cupertino, CA (US)

(72) Inventors: Robert V. Weber, Redwood City, CA (US); Min Chul Kim, San Jose, CA (US); Jay E. Sha, Menlo Park, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 17/355,095

(22) Filed: Jun. 22, 2021

(65) Prior Publication Data

US 2022/0403569 A1 Dec. 22, 2022

(51) Int. Cl.

| | |
|---|---|
| ***D04C 1/12*** | (2006.01) |
| *D04C 3/22* | (2006.01) |
| *D07B 7/02* | (2006.01) |

(52) U.S. Cl.

CPC ..... *D04C 1/12* (2013.01); *D04C 3/22* (2013.01); *D07B 7/021* (2021.01); *D07B 2201/209* (2013.01); *D07B 2201/2075* (2013.01); *D07B 2201/2089* (2013.01)

(58) Field of Classification Search

CPC ..... D04C 1/12; D07B 2201/2075; D07B 2201/2089; D07B 2201/209; H01R 24/28

See application file for complete search history.

(56) References Cited

U.S. PATENT DOCUMENTS

| | | | | |
|---|---|---|---|---|
| 1,913,292 A | | 6/1933 | Schweiter | |
| 2,377,003 A | * | 5/1945 | Hackbarth | H01B 13/008 87/34 |
| 4,593,964 A | * | 6/1986 | Forney, Jr. | H01R 24/562 439/585 |
| 4,640,178 A | * | 2/1987 | Kurzbock | D07B 1/02 87/8 |

(Continued)

FOREIGN PATENT DOCUMENTS

WO 2021013500 A1 1/2021

OTHER PUBLICATIONS

Lloyd, C. et al., "Braiding of wire/cable products with Wardwell rotary braiders", Wire and Cable Technical Symposium (WCTS), Wire Association International Inc., pp. 346-347, (2001). [Abstract Only; p. 4].

*Primary Examiner* — Shaun R Hurley
(74) *Attorney, Agent, or Firm* — BakerHostetler

(57) ABSTRACT

This application relates to cable assemblies with an outer (exterior) layer formed from braiding materials together. To achieve a desired pattern, a machine tool forming the outer layer undergoes several modifications. For a machine tool with two tracks (e.g., inner and outer track) with multiple carriers of material to be braided, each carrier position may include multiple bobbins, with each bobbin carrying a spool/coil of the material. During a braiding operation performed by the machine tool, each track rotates in opposite directions. Moreover, some bobbins include an arm that guides the material in a particular manner. For example, during rotation of the track, the arm provides a swinging motion, causing the material carried by the arm to move in a periodic (e.g., sinusoidal) motion. An additional track may be used to guide the arms.

17 Claims, 14 Drawing Sheets

(56) References Cited

U.S. PATENT DOCUMENTS

| | | | | |
|---|---|---|---|---|
| 4,980,517 | A * | 12/1990 | Cardas | H01B 7/0009 57/216 |
| 5,257,571 | A | 11/1993 | Richardson | |
| 5,500,488 | A * | 3/1996 | Buckel | H01B 11/1808 174/131 A |
| 5,749,280 | A | 5/1998 | Scherzinger | |
| 2002/0170417 | A1* | 11/2002 | Faborsky | D07B 1/02 87/34 |
| 2011/0061519 | A1* | 3/2011 | Fields | D03D 15/47 87/2 |
| 2013/0170038 | A1* | 7/2013 | Sheng | D07B 1/148 359/515 |
| 2013/0247534 | A1* | 9/2013 | Canedo Duarte da Rocha | D07B 1/02 57/220 |
| 2015/0167449 | A1* | 6/2015 | Rodney | E21B 47/06 166/385 |
| 2017/0125958 | A1* | 5/2017 | Kim | H01R 24/28 |
| 2018/0037176 | A1* | 2/2018 | Kodama | H01R 24/28 |
| 2019/0119850 | A1* | 4/2019 | Erlendsson | D07B 5/00 |
| 2020/0010986 | A1 | 1/2020 | Falkenberg | |
| 2020/0234853 | A1* | 7/2020 | Lee | H01B 7/423 |
| 2020/0244013 | A1* | 7/2020 | Hsu | H01R 43/20 |
| 2020/0343650 | A1* | 10/2020 | Shiraishi | H01B 7/181 |

* cited by examiner

BRAIDED ELECTRONIC DEVICE CABLE, BRAIDING MACHINE AND METHOD FOR BRAIDING AN ELECTRONIC DEVICE CABLE

FIELD

The described embodiments relate generally to cable assemblies, or cord assemblies, for portable electronic devices. More particularly, the present embodiments relate to yarn braiding techniques used to create an exterior for cable assemblies.

BACKGROUND

A cable may include a sheath, or sleeve, used to bundle together multiple wires of the cable. Typically, the sheath is covered by an outer layer using materials such as polymers (e.g., polyvinyl chloride or the like) that forms the exterior of the cable. The sheath may include several metal wires, such as copper wires, that form a protective cover for the wires that carry electrical signals. Additionally, the sheath can protect users from energized wires.

Machine automation is commonly used for sheath production. There are several factors for using sheath-like design as an interior feature as opposed to an exterior, aesthetic exterior for a consumer product. For instance, braided sheaths produced by typical machine braiding tools often include inconsistencies in wire angle, percent coverage, and density. While this can be tolerated when the sheathed is covered, it becomes easily detectable issue when the sheath represents an exterior. When machine modifications are adopted to increase consistency of manufacture, the throughput (i.e., rate of production) often decreases making less feasible to produce a sheath-like design as an exterior feature. As a result, manufacturers are typically limited in design choice.

SUMMARY

In one aspect of the present disclosure, a machine tool for manufacturing a cable assembly is described. The machine tool may include a first set of bobbins configured for rotational movement in a first direction. The first set of bobbins may include a first bobbin and a second bobbin. The machine tool may further include a second set of bobbins configured for rotational movement in a second direction different from the first direction. The second set of bobbins may include a third bobbin that carries a material. The machine tool may include a track defining a periodic pattern. The machine tool may include an arm coupled with the track. The arm can be configured to actuate the material over the first bobbin and under the second bobbin based on the periodic pattern.

In another aspect of the present disclosure, a method for manufacturing a cable assembly is described. The method may include, by a machine tool, driving a first track in a first direction. The first track may carry a first set of strands. The method may further include, by the machine tool, driving a second track in a second direction opposite the first direction. The second track may carry a second set of strands. The method may further include, by the machine tool, actuating, by a plurality of arms, the second set of strands while the plurality of arms moves in the second direction. In some embodiments, the plurality of arms guides the second set of strands in accordance with a periodic pattern.

In another aspect of the present disclosure, a cable assembly is described. The cable assembly may include a first connector. The cable assembly may further include a second connector. The cable assembly may further include a cord extending between the first connector and the second connector. The cord may include an outer layer. The outer layer may include a first set of strands. The outer layer may further include a second set of strands adjacent to the first set of strands. The outer layer may further include a third set of strands weaved with the first set of strands and the second set of strands.

Other aspects and advantages of the invention will become apparent from the following detailed description taken in conjunction with the accompanying drawings which illustrate, by way of example, the principles of the described embodiments.

This Summary is provided merely for purposes of summarizing some example embodiments so as to provide a basic understanding of some aspects of the subject matter described herein. Accordingly, it will be appreciated that the above-described features are merely examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The disclosure will be readily understood by the following detailed description in conjunction with the accompanying drawings, wherein like reference numerals designate like structural elements.

DETAILED DESCRIPTION

Figure 1:
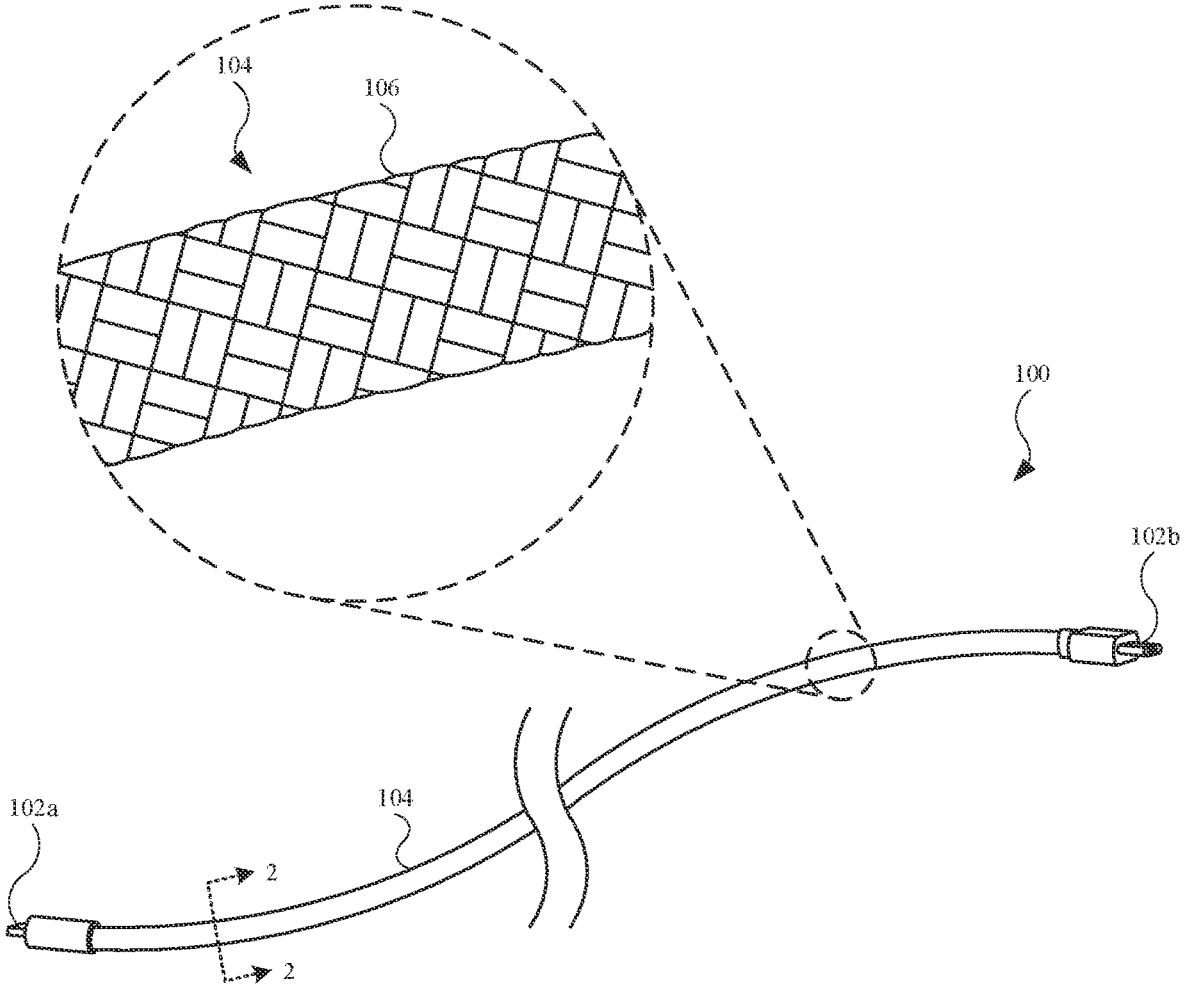
FIG. 1 illustrates an isometric view of an embodiment of a cable assembly.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process steps have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

This application is directed to cable assemblies with a braided outer layer, or braided exterior, as well as a machine tool used to form the braided outer layer. Cable assemblies described herein are used to facilitate power transmission from a power adapter used to connected to, for example, a 110-120 Volt ("V") source to an electronic device (e.g., smartphone, desktop computing device, smartwatch, laptop computing device, tablet computing device, or the like). Alternatively, or in combination, cable assemblies described herein are used to facilitate power transmission and/or communication (e.g., data) from one electronic device to another electronic device.

In an exemplary embodiment, a cable assembly includes an outer layer made from multiple strands of yarn braided together. In particular, the outer layer may include a braided pattern in accordance with the formula $$a \times b - c$$

where a is the group number of strands (e.g., yarns) passing over a group number of b strands and under a group number of b strands, and c is the number of strands in each of the aforementioned groups. For example, a 1×1−2 braided pattern includes 1 group of strands passing over 1 group of strands and under 1 group of strands, with each group having 2 strands. In this manner, a machine tool can form a 1×1−2 braided pattern by using 2 (or c) bobbins at each carrier position. In this detailed description, a and b may vary from 1 to 5, while c may vary from 1 to 10.

In order to create the outer layer of a cable assembly, the machine tool may include a rotary braiding machine with several modifications. For example, a 2-track machine tool, each with multiple carriers used to hold a bobbin (or multiple bobbins at a single carrier position), may include a track with several arms used to guide or direct the strand of material as it rolls off of a respective bobbin. The arm can be passively driven, i.e., connected to an additional track that cause the arm to move along a path defined by the additional track. In some exemplary embodiments, the additional track includes a periodic pattern such as a sinusoidal pattern. Based on the position of the track on the machine tool, the actuation of the strands of material (guided by their respective arm) moves the strand toward and away from the other track of bobbins, thus providing a braiding/weaving operation. In some exemplary embodiments, the 2-track machine tool includes an inner and outer track, each with several carriers. Each bobbin on the outer track includes an arm that guides the strands of material off of the bobbin in a direction toward (and in some cases, radially inside) bobbins on the inner track, and also away from (and radially outside) the bobbins on the inner track, thus defining a periodic pattern. As an alternative to a track with a design with a periodic pattern, a motor can be equipped to each arm to drive the arm in a desired manner, which may include a periodic motion.

Traditional rotary braiding machines for cable assemblies form sheaths used to hold together wires of the cable assembly. These braided sheaths are subsequently covered by an outer layer such that the sheath is unseen. However, the braiding operation described herein is used to create the outer, or exterior, layer, and accordingly, factors such as strand angle, percent coverage, and strand density—all related to the appearance of the outer layer, and subsequently the cable assembly—are relatively more important. In this regard, an additional modifications to machine tools can be used. For example, machine tools described herein may include a fixture centrally mounted to the machine tools. The fixture is used as an initial receiving surface for the outer layer undergoing a braiding operation. The fixture further includes a hollow cylindrical body that defines a through hole through which the internal features (e.g., cable core that includes wires and other internal features) of cable assemblies pass. Additionally, the fixture may include a tapered body in which a diameter at one end is greater than that of the other end. This fixture is designed to reduce tension on the braided outer layer during a manufacturing operation and keep the braided outer layer momentarily separated from the cable core. As a result, the braided outer layer undergoes less stress and tension, leading to a more consistent and aesthetic finish.

These and other embodiments are discussed below with reference to FIGS. 1-15. However, those skilled in the art will readily appreciate that the detailed description given herein with respect to these figures is for explanatory purposes only and should not be construed as limiting.

FIG. 1 illustrates an isometric view of an embodiment of a cable assembly 100. Cable assembly 100 (representative of other cable assemblies shown and described herein) is designed for use with various electronic devices including, but not limited to, smartphones, laptop computing devices, desktop computing devices, tablet computing devices, wireless headphones, and digital styluses. As shown, cable assembly 100 includes a connector 102*a* and a connector 102*b*. Each of connectors 102*a* and 102*b* may include an electrical connector designed in accordance with an industry standard including, but not limited to, Universal Serial Bus ("USB"), USB-C, Lightning, Thunderbolt, or micro-USB.

Also, cable assembly 100 includes a cable 104, or cord, extending between and connected with connectors 102*a* and 102*b*. Cable 104 is designed to cover and carry one or more wires used for power transmission and/or data transmission from connector 102*a* to connector 102*b*, or vice versa, and accordingly, cable assembly 100 can provide power transmission and/or data transmission, respectively, to various electronic devices. As shown in the enlarged view, cable 104 includes an outer layer 106, also referred to as an exterior or exterior layer. In some embodiments, outer layer 106 includes several strands of material braided or interweaved together. The strands of material may include yarn, as a non-limiting example. Outer layer 106, including the manufacturing and design, will be shown and described below.

Figure 2:
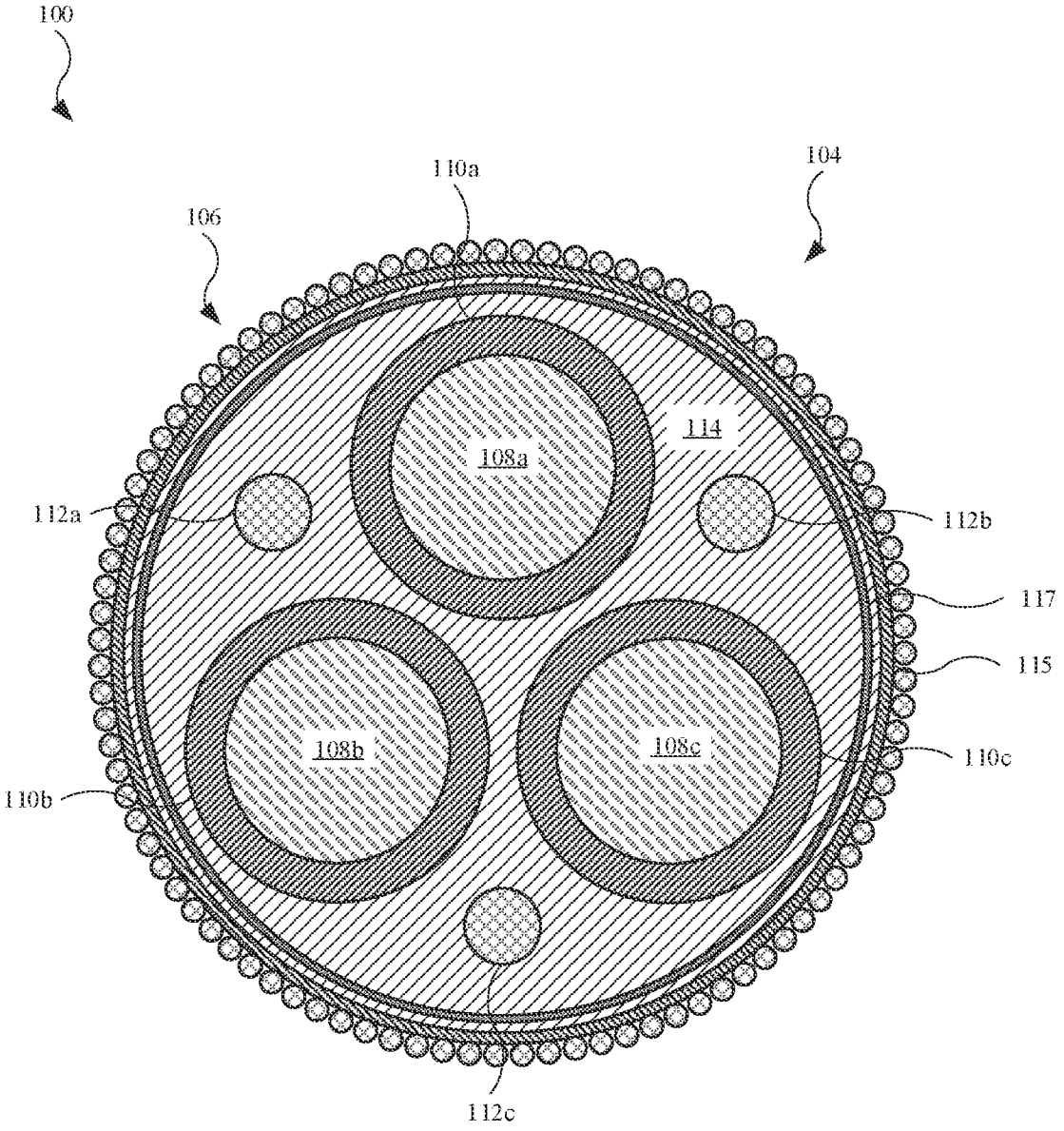
FIG. 2 illustrates a cross sectional view of the cable assembly taken across line 2-2, showing various internal features of the cable assembly.

FIG. 2 illustrates a cross sectional view of cable assembly 100 taken across line 2-2, showing various internal features of cable 104. As shown, outer layer 106 provides an exterior structure and surface of cable 104. Additionally, cable 104 includes a wire 108*a*, a wire 108*b*, and a wire 108*c*, each of which are covered/wrapped by an insulator 110*a*, insulator 110*b*, and insulator 110*c*, respectively. Wires 108*a*, 108*b*, and 108*c* provide an electrically conductive pathway and accordingly include a conductive metal, such as copper. Wires 108*a*, 108*b*, and 108*c* are electrically connected to connectors 102*a* and 102*b* (shown in FIG. 1). Insulators 110*a*, 110*b*, and 110*c* include electrically an insulating material, such as a polymer. Additionally, in order to increase power transmission and/or data transmission, cable 104 may include an uninsulated wire 112*a*, an uninsulated wire 112*b*, and an uninsulated wire 112*c*, each of which is electrically connected to connectors 102*a* and 102*b*. Also, cable 104 may further include a fill material 114, such as nylon. Fill material 114 may generally include any material (s) with flexible properties while providing some rigidity.

Additionally, cable 104 may include a sheath 115 used to provide some compression forces to the components of cable 104. Additionally, cable 104 may include a metal separator 117 designed to provide some grounding for static charges. The features and components within and include sheath 115 may define a cable core for cable 104 of cable assembly 100.

Figure 3:
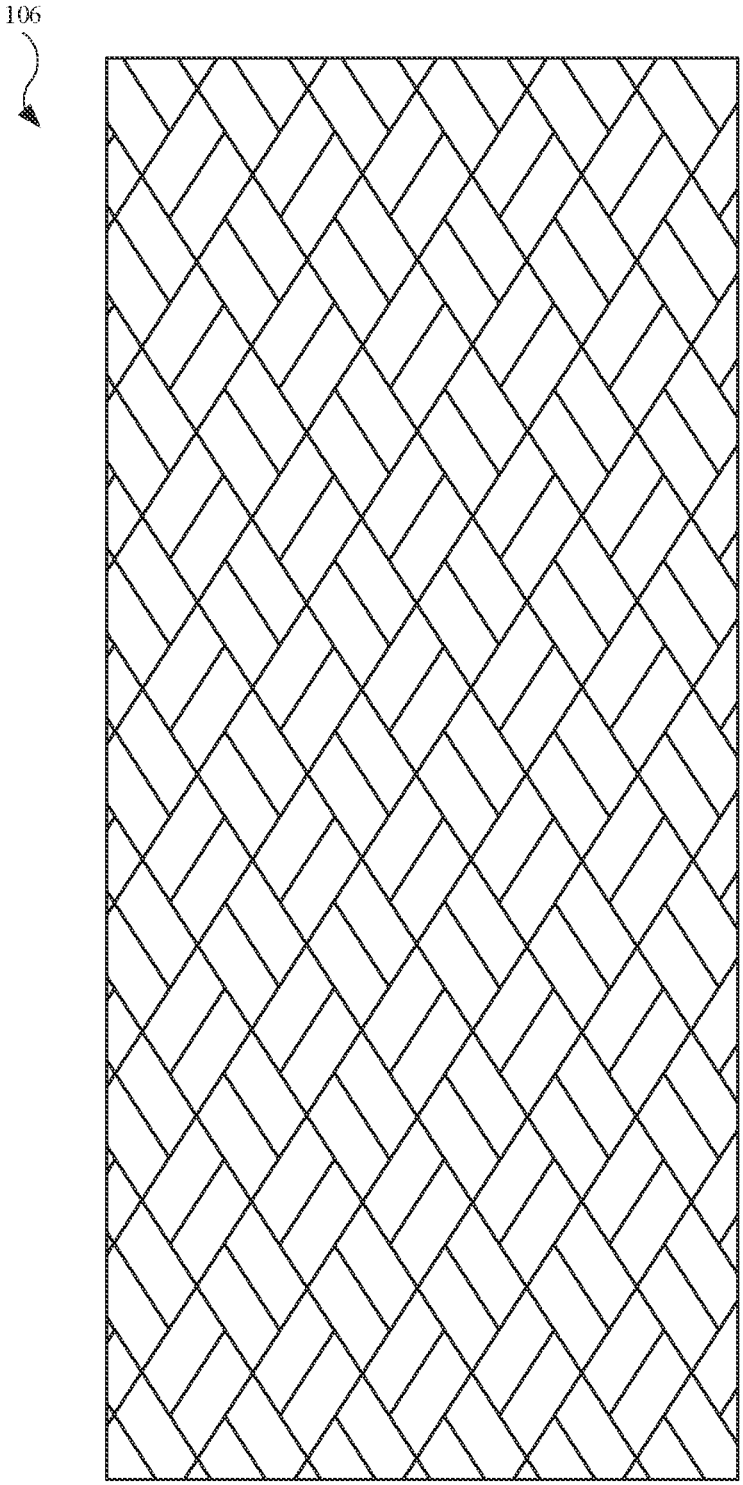
FIG. 3 illustrates a plan view of the outer layer of the cable assembly.

FIG. 3 illustrates a plan view of outer layer 106 of cable assembly 100. As shown, outer layer 106 is detached from cable assembly 100 and laid flat. Outer layer 106 includes multiple strands of material (shown, not labeled) braided or interweaved together. Accordingly, several strands of material pass over some strands of material and pass under other strands of material.

Figure 4:
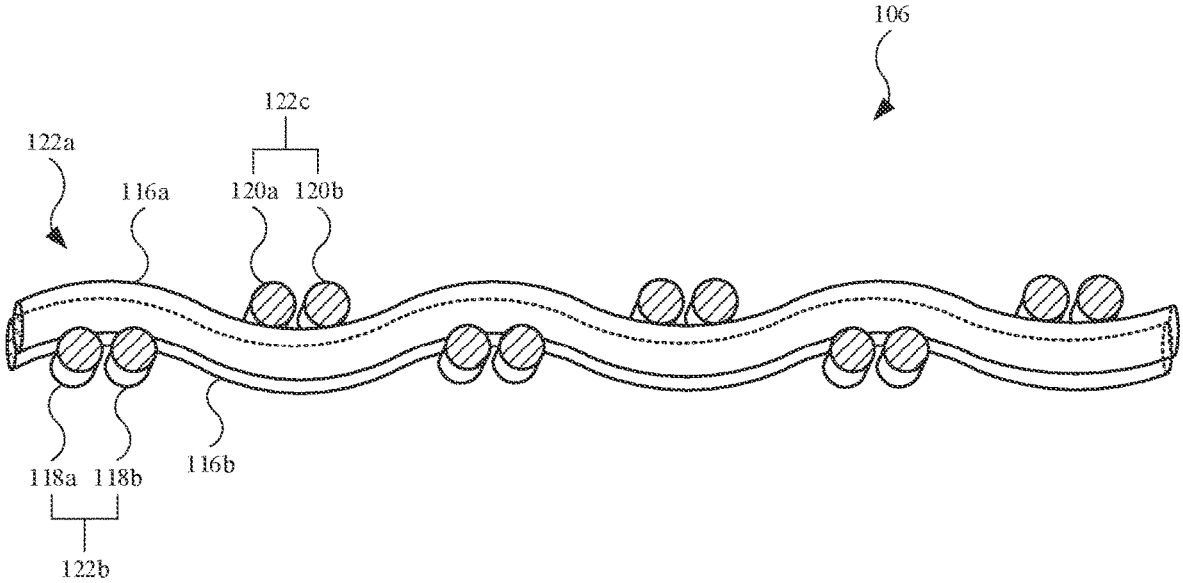
FIG. 4 illustrates a partial cross sectional view of the outer layer, showing a pattern of the strands of material of the outer layer.

FIG. 4 illustrates a partial cross sectional view of outer layer 106, showing a pattern of the strands of material of outer layer 106. As shown, outer layer 106 includes a strand 116*a* and a strand 116*b* extending along the same direction. In other words, strands 116*a* and 116*b* are parallel to each other. Outer layer 106 includes additional strands that extend along a different direction as compared to strands 116*a* and 116*b*, and accordingly, can cross/intersect strands 116*a* and 116*b*. For example, outer layer 106 includes a strand 118*a* and a strand 118*b* extending along the same direction, as well as a strand 120*a* and a strand 120*b* extending along the same direction. As shown, strands 116*a* and 116*b* pass over strands 118*a* and 118*b*, and subsequently pass under strands 120*a* and 120*b*.

The strands may be divided into groups. For example, strands 116*a* and 116*b* define a group 122*a* of strands, strands 118*a* and 118*b* define a group 122*b* of strands, and strands 120*a* and 120*b* define a group 122*c* of strands. In this manner, it can be said that group 122*a* passes over group 122*b*, and subsequently passes under group 122*c*. In some embodiments (as shown in FIG. 4), groups 122*b* and 122*c* are adjacent to each other. With reference to strands, the term "adjacent" or phrase "adjacent groups" as used in this detailed description and in the claims can refer to two groups (including their respective strands) extending in the same direction (i.e., parallel) and not separated by another group. Also, as shown, group 122*a* is interweaved with adjacent groups, with groups 122*b* and 122*c* being representative examples.

Figure 5:
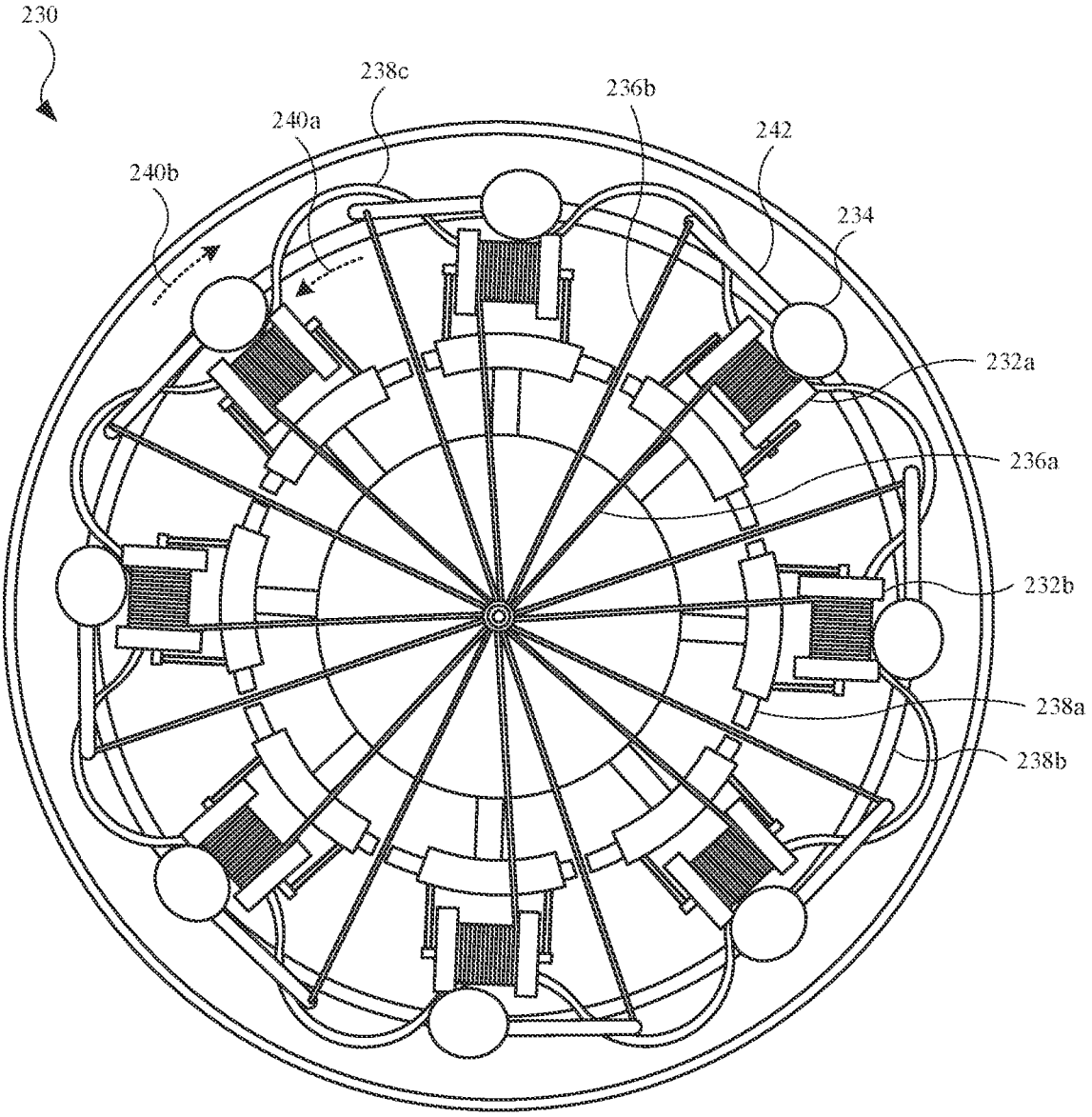
FIG. 5 illustrates a plan view of a machine tool designed to manufacture outer layers for cable assemblies, in accordance with some described embodiments.

FIG. 5 illustrates a plan view of a machine tool 230 designed to manufacture outer layers for cable assemblies, in accordance with some described embodiments. Machine tool 230 includes multiple carrier positions designed to hold one or more bobbins, or spools, loaded with material used to create an outer layer. For example, machine tool 230 includes a bobbin 232*a* and a bobbin 234 at a respective carrier position, each of which representing additional bobbins of machine tool 230. As shown, bobbins 232*a* and 234 each provide a strand 236*a* and a strand 236*b*, respectively. Strands 236*a* and 236*b* may include one or more fibers of material. In this regard, strands 236*a* and 236*b* may include yarn, as a non-limiting example. However, various fabrics and synthetic materials are also possible for strands 236*a* and 236*b*. While each of bobbins 232*a* and 234 include a strand of material, bobbins 232*a* and 234 are located on different tracks. For example, bobbin 232*a*, as well as other similarly-looking bobbins, are carried on a track 238*a* while bobbin 234, as well as other similarly-looking bobbins, are carried on a track 238*b*. Tracks 238*a* and 238*b* may be referred to an inner track and an outer track, respectively, based upon their respective locations.

In order for perform a braiding operation, machine tool 230 drives tracks 238*a* and 238*b* in opposite directions. For example, track 238*a* is designed to be driven in a direction denoted by an arrow 240*a*, while track 238*b* is designed to be driven in a direction denoted by an arrow 240*b*. Although not shown, tracks 238*a* and 238*b* may be driven by one or more motors of machine tool 230. The directions denoted by arrows 240*a* and 240*b* may denote a counterclockwise direction and a counter-clockwise direction, respectively. Generally, machine tool 230 may function by driving each of tracks 238*a* and 238*b* in their respective opposite directions as shown. The respective strands on the bobbins on track 238*a* are braided with strands on the bobbins on track 238*b*.

Additionally, in order to further create a desired finish an outer layer of a cable assembly, machine tool 230 may include additional modifications to at least some of the bobbins. For example, machine tool 230 include a track 238*c* as well as an arm 242 that is coupled with track 238*c*. Track 238*c* can define a periodic pattern, repeating at defined intervals. For example, in some embodiments, track 238*c* defines a sinusoidal pattern that repeats itself each period. As a result, when track 238*b* moves in direction of arrow 240*b* (i.e., a circular motion), arm 242, being coupled with track 238*c*, moves not only with bobbin 234 in the direction of arrow 240*b*, but also swings or oscillates in a manner defined by the shape and curvature of track 238*c*, i.e., the periodic pattern. Additionally, strand 236*b* (located on bobbin 234) is directed/guided by arm 242, and accordingly, strand 236*b* also moves in accordance with the periodic pattern of track 238*c*. As shown, additional arms (not labeled) are coupled to a bobbin on track 238*b* and capable of directing a respective strand loaded on a bobbin on track 238*b*.

Further, in addition to the periodic pattern, the layout and dimensions of track 238*c*, allow arm 242 and strand 236*b* to pass between adjacent bobbins. For example, based on track 238*c*, arm 242 and strand 236*b* can pass between bobbin 232*a* and a bobbin 232*b*, where bobbin 232*b* is adjacent to bobbin 232*a* and on track 238*a*. With reference to bobbins, the term "adjacent" or the phrase "adjacent bobbins" as used in this detailed description and in the claims can refer to two bobbins on the same track and not separated by another bobbin on the same track.

Figure 6:
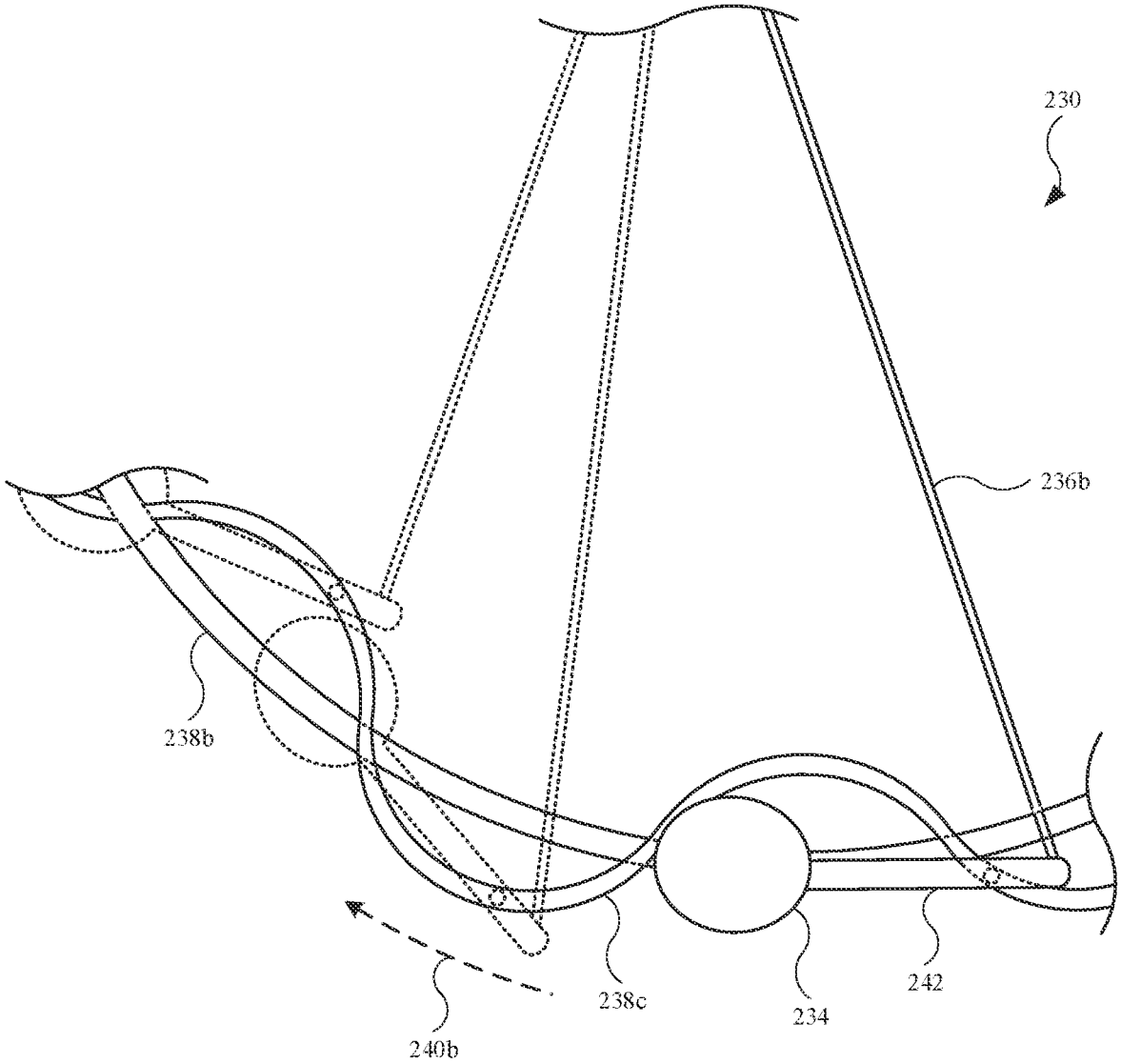
FIG. 6 illustrates an enlarged view of the machine tool shown in FIG. 5, showing exemplary movement at various positions of a bobbin during operation.

FIG. 6 illustrates an enlarged view of machine tool 230 shown in FIG. 5, showing exemplary movement at various positions of bobbin 234 during operation. For purpose of illustration and simplicity, some features of machine tool 230 are removed. The dotted lines show several different positions of bobbin 234, arm 242, and strand 236*b* during operation of machine tool 230. For example, while bobbin 234 travels along track 238*b*, arm 242 moves along the periodic pattern defined by track 238*c*, and accordingly, although both bobbin 234 and arm 242 move along the direction of arrow 240*b*, arm 242 nonetheless moves relative to bobbin 234. Additionally, strand 236*b* is directed by arm 242, and accordingly moves along the periodic pattern defined by track 238*c*.

Figure 7:
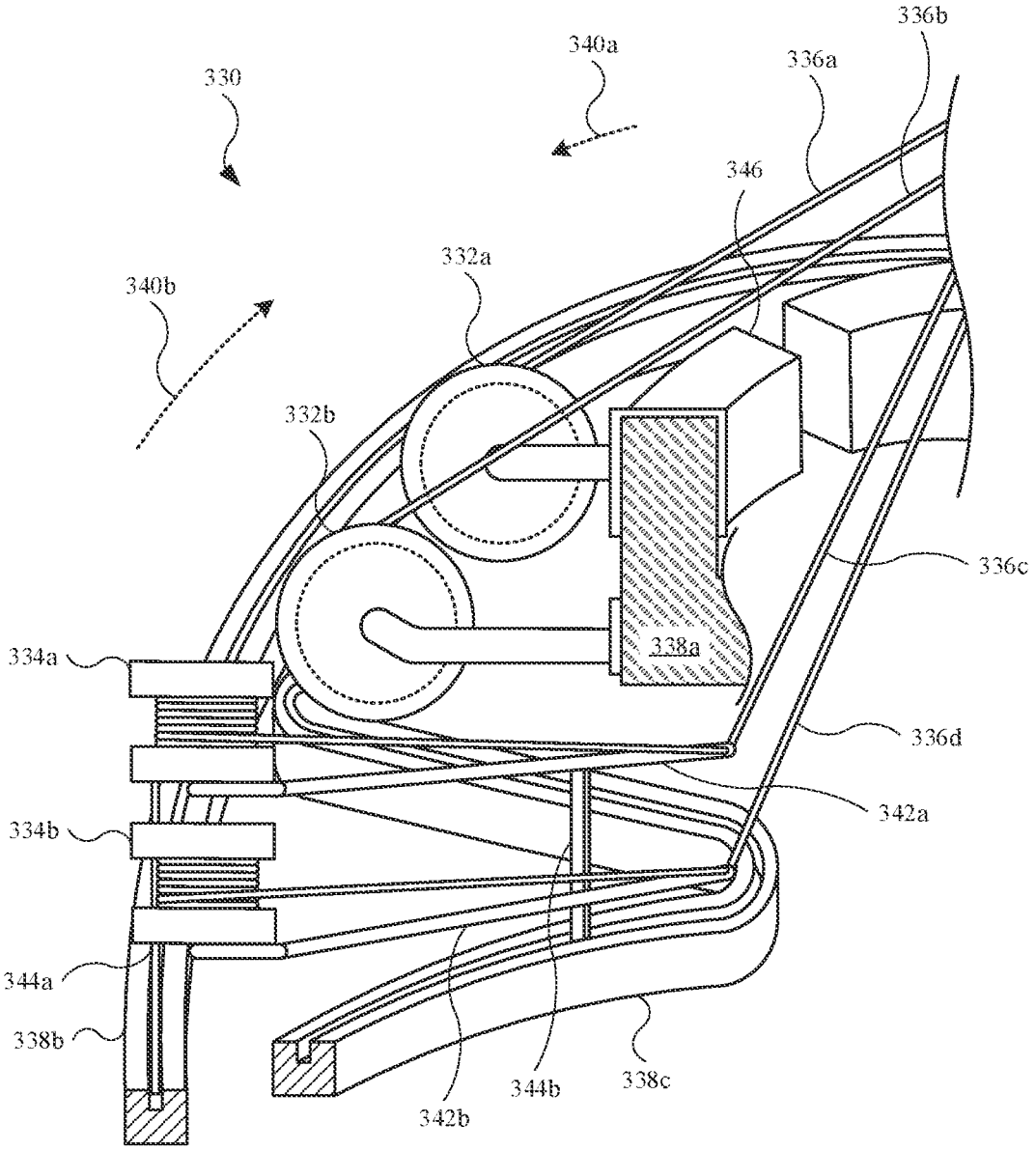
FIG. 7 illustrates an enlarged view of an alternate embodiment of a machine tool, showing multiple bobbins at a single carrier position, in accordance with some described embodiments.

FIG. 7 illustrates an enlarged view of an alternate embodiment of a machine tool 330, showing multiple bobbins at a single carrier position, in accordance with some described embodiments. Machine tool 330 may include any features shown and described herein for a machine tool. Additionally, however, machine tool 330 may include two bobbins at a single carrier position. For example, machine tool 330 includes a bobbin 332*a* and a bobbin 332*b* at a carrier position on a track 338*a*, and carrying a strand 336*a* and a strand 336*b*, respectively. Also, machine tool 330 includes a bobbin 334*a* and a bobbin 334*b* at a carrier position on a track 338*b*, and carrying a strand 336*c* and a strand 336*d*, respectively. Additionally, bobbins 334*a* and 334*b* include an arm 342*a* and an arm 342*b*, respectively, with arms 342*a* and 342*b* used to guide strands 336*c* and 336*d*, respectively. Bobbins 334*a* and 334*b* are coupled to track 338*b* by a support 344*a*, while arms 342*a* and 342*b* coupled to track 338*c* by a support 344*b*. Supports 344*a* and 344*b* are positioned in grooves of tracks 338*b* and 338*c*, respectively.

Tracks 338*a*, 338*b*, and 338*c* may include similar features and designs for tracks 238*a*, 238*b*, and 238*c*, respectively (shown in FIG. 5). Accordingly, tracks 338*a* and 338*b* can be driven in directions 340*a* and 340*b*, respectively (i.e., opposite directions), and track 338*c* may define a periodic pattern, including a sinusoidal pattern. In this manner, during operation, arms 342*a* and 342*b* can move with bobbins 334*a* and 334*b*, respectively, and simultaneously move/swing/oscillate, thereby guiding strands 336*c* and 336*d*, respectively, along the periodic pattern. The movement action of the arms 342*a* and 342*b* can cause strands 336*c* and 336*d*, respectively, to move radially inside and outside bobbins 332*a* and 332*b* located on track 338*a*. In this manner, track 338*a* may include an opening 346 that allows strands 336*c* and 336*d* to pass through track 338*a*.

Based on the dual bobbin configuration, machine tool 330 can form an outer layer (previously described) with a 1×1−2 braided pattern. In other words, a single group of two strands (e.g., strands 336*a* and 336*b*) can pass over another single group of two strands (e.g., strands 336*c* and 336*d*) and under another group of two strands (i.e., another dual bobbin at a carrier position on track 338*b*). In this regard, although not shown, arms 342*a* and 342*b* can swing strands 336*c* and 336*d*, respectively, over another dual bobbin configuration located on track 338*a* that is adjacent to bobbins 332*a* and 332*b*. With multiple groups of dual bobbins at various carrier positions (not shown in FIG. 7) of machine tool 330, the outer layer can be formed in accordance with the 1×1−2 pattern. Further, although not shown, the "2" in 1×1−2 can be altered (increased or decreased) based upon the number of bobbins at a single carrier position.

Figure 8:
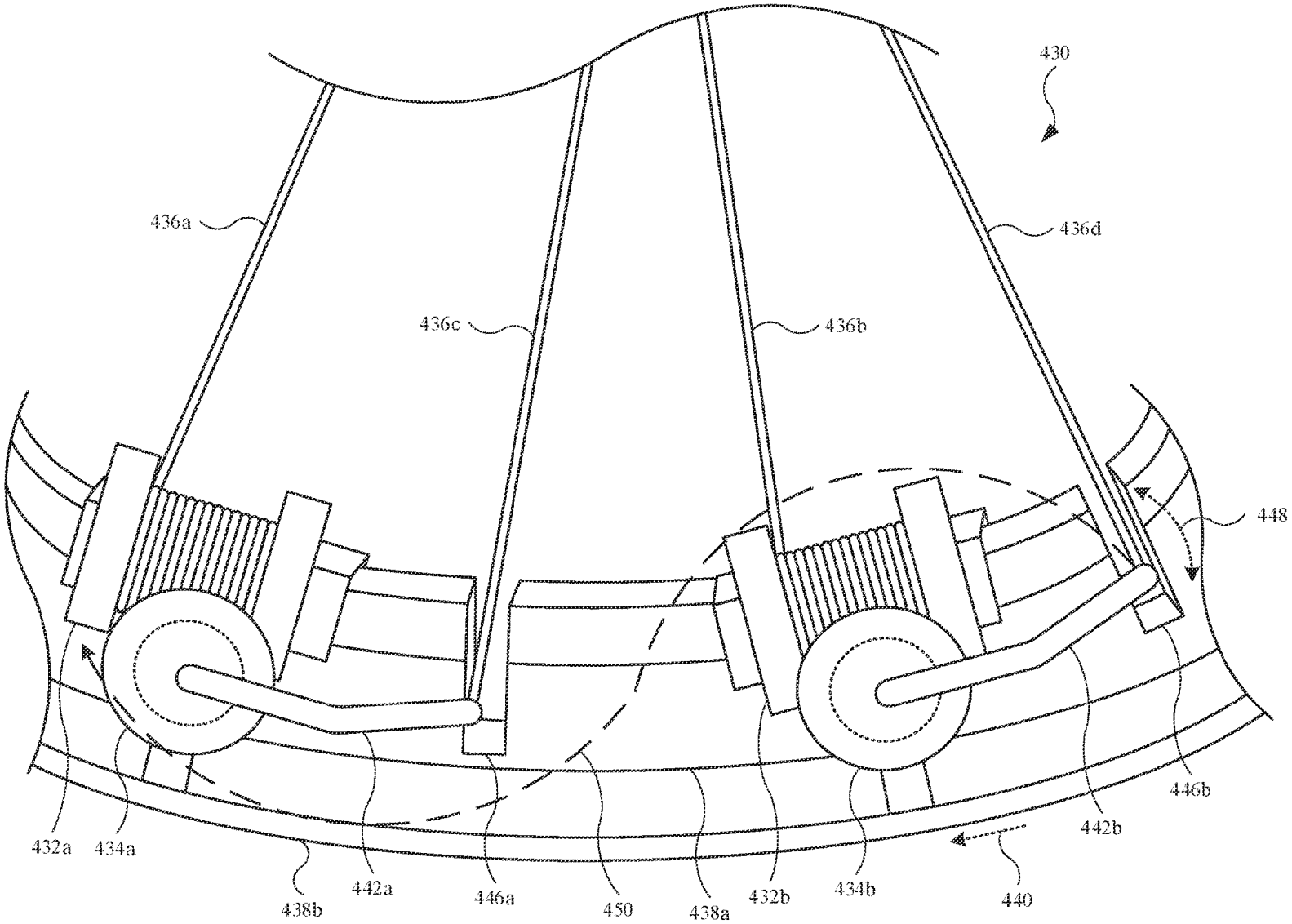
FIG. 8 illustrates an enlarged view of an alternate embodiment of a machine tool, showing a different movement of arms, in accordance with some described embodiments.

FIG. 8 illustrates an enlarged view of an alternate embodiment of a machine tool 430, showing a different movement of arms, in accordance with some described embodiments. Machine tool 430 may include any features shown and described herein for a machine tool. For example, machine tool 430 includes a bobbin 432*a* and a bobbin 432*b* on a track 438*a*, and carrying a strand 436*a* and a strand 436*b*, respectively. Also, machine tool 430 includes a bobbin 434*a* and a bobbin 434*b* at a carrier position on a track 438 *b*, and carrying a strand 436*c* and a strand 436*d*, respectively. Additionally, bobbins 434*a* and 434*b* include an arm 442*a* and an arm 442*b*, respectively.

Tracks 438*a* and 438*b* may include similar features and designs for tracks 238*a* and 238*b*, respectively (shown in FIG. 5). Accordingly, tracks 438*a* and 438*b* can be driven in opposite directions. In order to drive arms 442*a* and 442*b*, machine tool 430 may further include motors (e.g., servo motors) that drive arms 442*a* and 442*b* to swing/oscillate arms 442*a* and 442*b* in a direction of the two-sided arrow 448. In this manner, during operation, track 438*b* moves in the direction of the arrow 440, causing bobbins 434*a* and 434*b* as well as arms 442*a* and 442*b* to move with track 438*b*, while arms 442*a* and 442*b* additionally swing/oscillate, thereby driving strands 436*c* and 436*d*, respectively, along the periodic pattern denoted by the arrow 450. The movement action of the arms 442*a* and 442*b* can cause strands 436*c* and 436*d*, respectively, to move above bobbin 432*b* and below 432*a*. Additionally, track 438*a* may include an opening 446*a* and an opening 446*b*, each of which allowing strands 436*c* and 436*d* to pass through track 438*a*.

Figure 9:
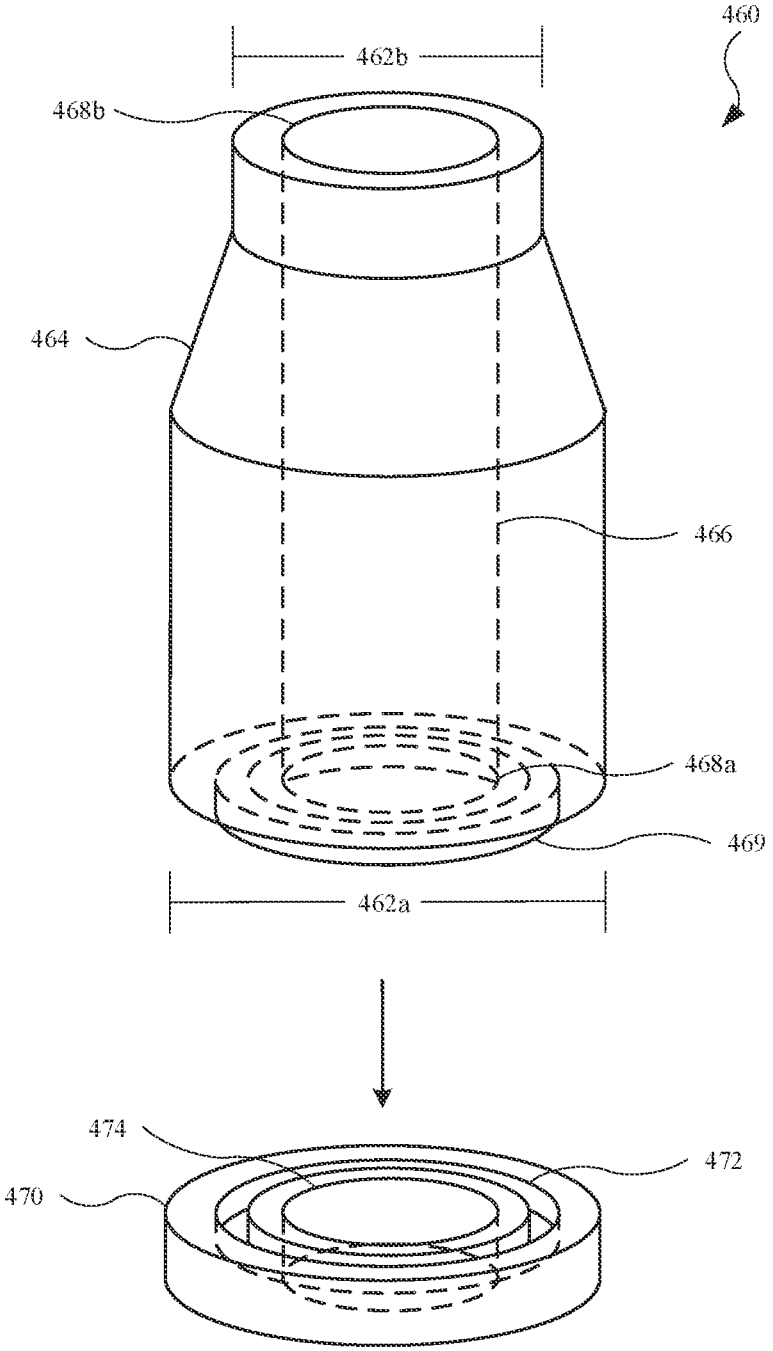
FIG. 9 illustrates an isometric view of a fixture designed for use with machine tools, in accordance with some described embodiments.

FIG. 9 illustrates an isometric view of a fixture 460 designed for use with machine tools, in accordance with some described embodiments. Fixture 460 can be mounted to any machine tool described herein. As shown, fixture 460 defines a cylindrical (or generally cylindrical) body having one end with a diameter 462*a*, a tapered region 464, and another end with a diameter 462*b*. Based upon tapered region 464, diameter 462*a* is greater than diameter 462*b*. Fixture 460 further includes a through hole 466 that opens to an opening 468*a* at one end (i.e., a receiving end) and an opening 468*b* at the other end (i.e., transmission end). In order to secure fixture 460 to a machine tool, a base 470 may be mounted to the machine tool. In this regard, fixture 460 includes a flange 469 designed to fit into a groove 472 of base 470.

Fixture 460 is designed to decrease tension on an outer layer (not shown in FIG. 9) during an assembly operation of the outer layer. For example, fixture 460 can be centrally mounted on a machine tool described herein, and during operation, the strands used to form the outer layer pass over the outer surface of fixture 460 while the cable core passes initially through a through hole 474 of base 470 and then through the through hole 466 by initially passing through opening 468*a* and then subsequently through opening 468*b*.

Figure 10:
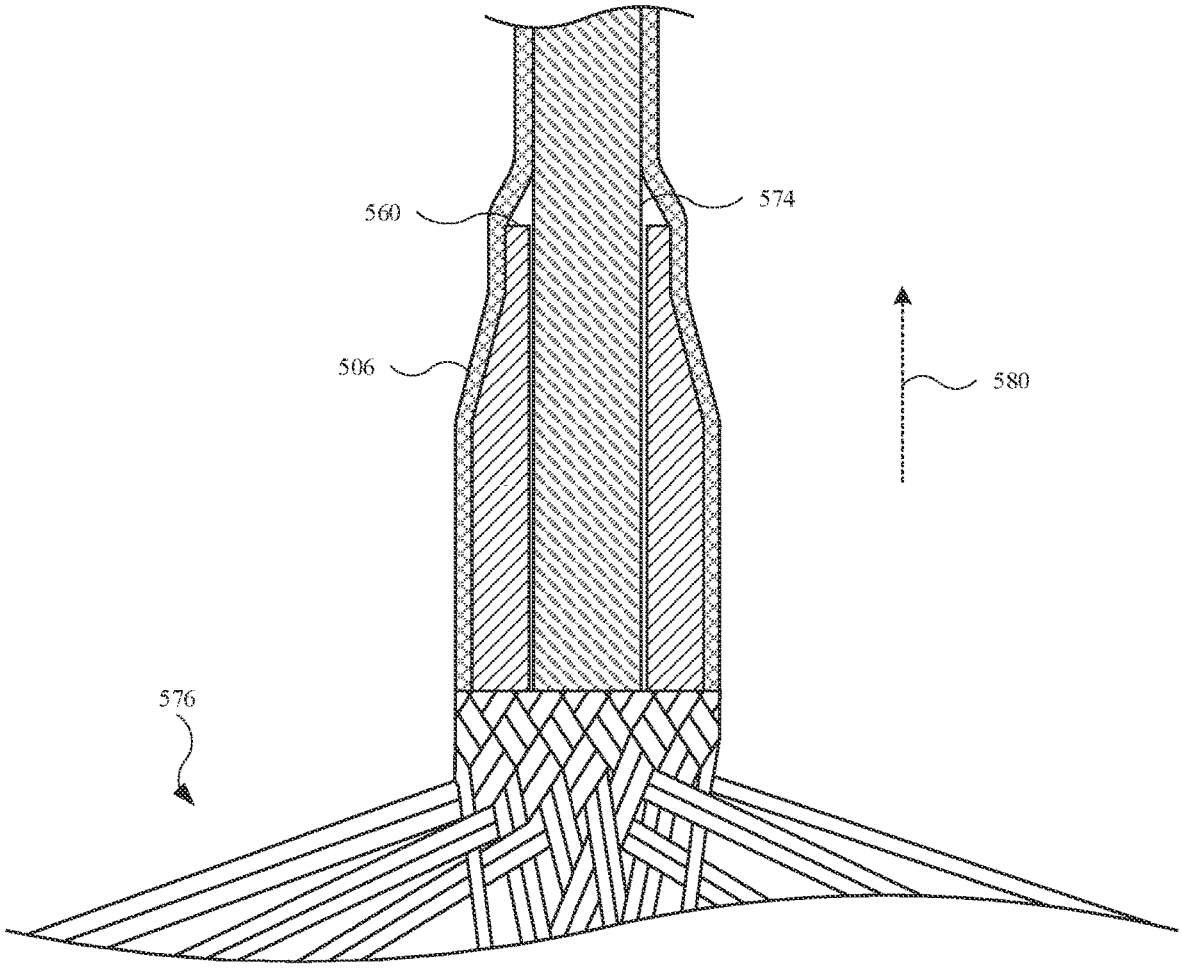
FIG. 10 illustrates a partial cross sectional view of a fixture used to manufacture a cable assembly, in accordance with some described embodiments.

FIG. 10 illustrates a partial cross sectional view of a fixture 560 used to manufacture a cable assembly, in accordance with some described embodiments. Fixture 560 may include any features shown and described for fixture 460 (shown in FIG. 9). During operation, both a cable core 574 of a cable assembly and strands 576 from various bobbins of a machine tool are directed to fixture 560. Strands 576 are braided to form an outer layer 506, which passes over the outer surface of fixture 560, while cable core 574 passes through a through hole (not labeled, but similar to through hole 466 in FIG. 9) of fixture 560. An arrow 580 is used to denote a direction of travel of cable core 574 and outer layer 506 during operation.

As shown, fixture 560 provides physical separation between outer layer 506 and cable core 574 during the formation of outer layer 506. As a result, cable core 574 imposes minimal, if any, stress on outer layer 506. This decoupling between outer layer 506 and cable core 574 provides a reduced stress environment for outer layer 506, and increases braiding consistency and aesthetics of outer layer 506. Further, a tapered region (not labeled, but similar to tapered region 464 in FIG. 9), along with the reduced end (similar to end with diameter 462*b* shown in FIG. 9) of fixture 560 provides a smooth transition of outer layer 506 to slip off of fixture 560 and onto cable core 574. In this manner, fixture 560 allows outer layer 506 transition onto cable core 574 without cable core 574 stretching outer layer 506 in a manner that alters the appearance of outer layer 506 in an undesired manner.

Figure 11A:
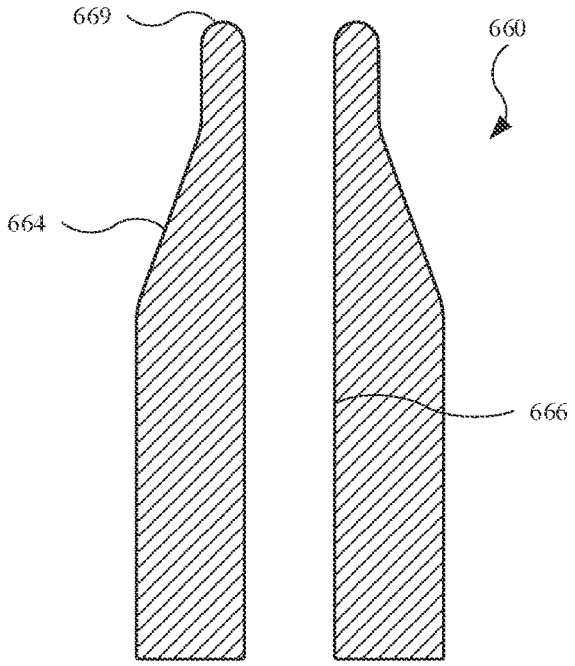
FIGS. 11A-11C illustrate alternate embodiments of fixtures.
Figure 11B:
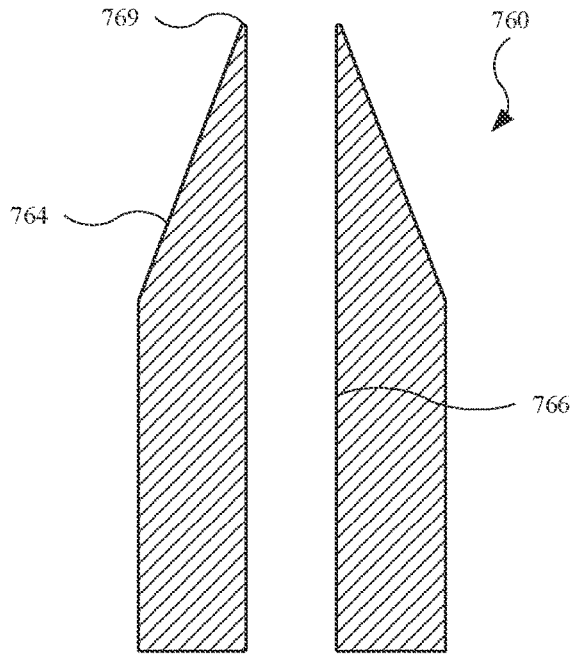
Figure 11C:
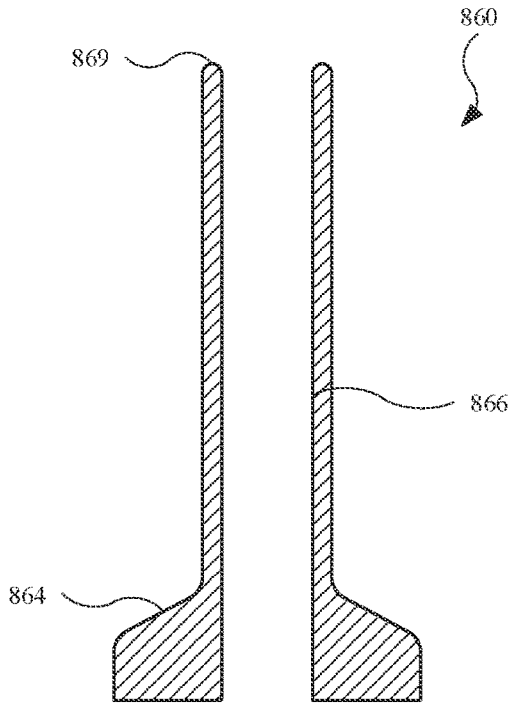

FIGS. 11A-11C illustrate cross sectional views of alternate embodiments of fixtures. Either of the fixtures shown and described in FIGS. 11A-11C can substitute for fixture 560 (shown in FIGS. 9 and 10). Additionally, fixtures 460 and 560 (shown in FIGS. 9 and 10, respectively) may be modified to include at least some features for the fixtures shown and described in FIGS. 11A-11C. FIG. 11A illustrates a cross sectional views of a fixture 660, in accordance with some described embodiments. Fixture 660 may define a cylindrical (or generally cylindrical) body having a tapered region 664 that transitions from a relatively larger diameter of fixture 660 to a relatively smaller diameter of fixture 660. Fixture 660 further includes a through hole 666 that extends through the body of fixture 660. Additionally, fixture 660 includes an end 669 that is rounded, or generally rounded, as opposed to an end with a flat surface. In some embodiments, end 669 is rounded with a half-cylinder shape.

FIG. 11B illustrates a cross sectional views of a fixture 760, in accordance with some described embodiments. Fixture 760 may define a cylindrical (or generally cylindrical) body having a tapered region 764 that transitions from a relatively larger diameter of fixture 760 to an end 769 of fixture 760, with end 769 defining a relatively smaller diameter. Fixture 760 further includes a through hole 766 that extends through the body of fixture 760. Also, end 769 can be rounded, flat, or pointed.

FIG. 11C illustrates a cross sectional views of a fixture 860, in accordance with some described embodiments. Fixture 860 may define a cylindrical (or generally cylindrical) body having a tapered region 864 that transitions a relatively larger diameter of fixture 860 to a relatively smaller diameter of fixture 860. Fixture 860 can resemble a body of a needle. For example, the relatively smaller diameter portion of fixture 860 is substantially longer than the relatively larger diameter portion of fixture 860. Accordingly, the strands (not shown in FIG. 11C) will pass over the relatively smaller diameter portion of fixture 860 during the braiding operation for a substantial duration of the braiding operation. Fixture 860 further includes a through hole 866 that extends through the body of fixture 860. Also, fixture 860 includes an end 869 that can be rounded, flat, or pointed.

Figure 12:
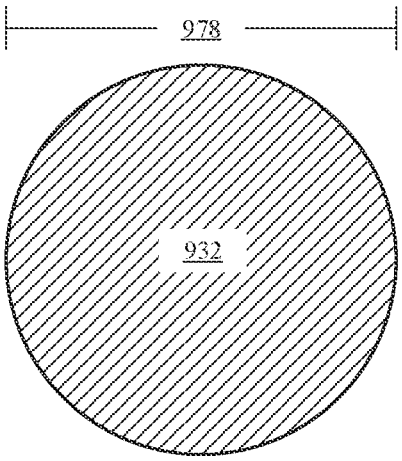
FIG. 12 illustrates a cross sectional view of a strand used to form an outer layer of a cable, in accordance with some described embodiments.
Figure 13:
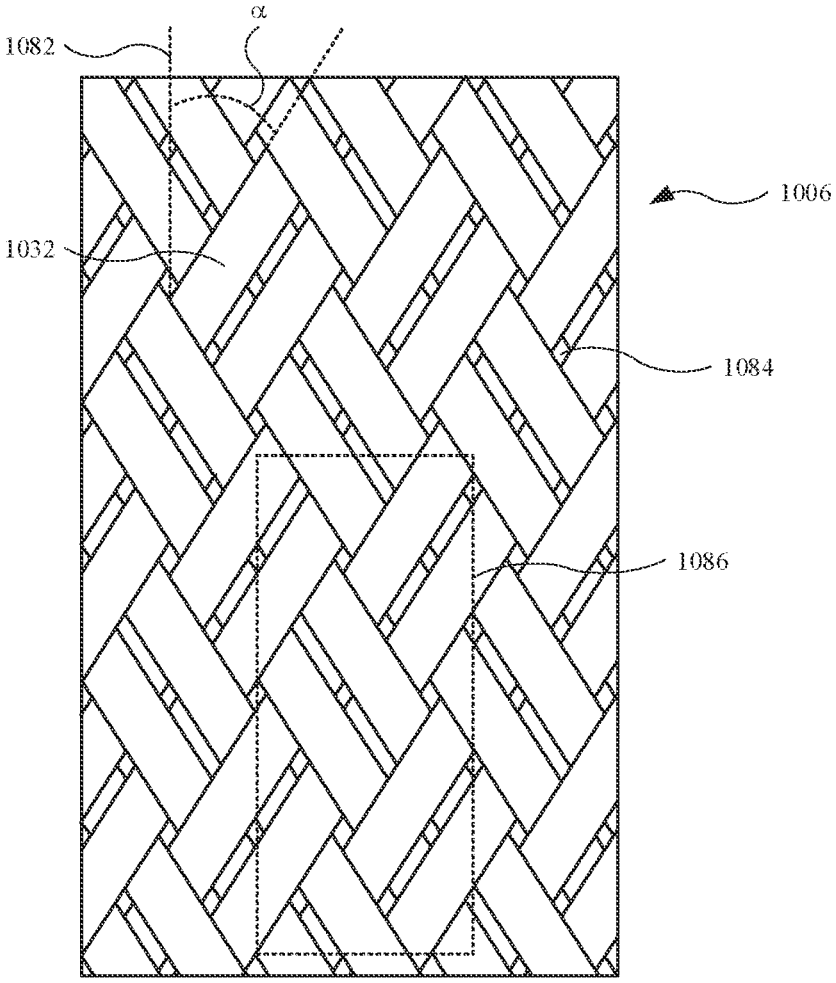
FIG. 13 illustrates a plan view of an outer layer of a cable, showing additional relationships of the strands of the outer layer, in accordance with some described embodiments.

FIGS. 12 and 13 show and describe features of strands of material used to form an outer layer, as well as relationship between braided strands that form an outer layer. The machine tools shown and described herein can be programmed or otherwise modified to produce outer layers with features and relationships shown and described in FIGS. 12 and 13.

FIG. 12 illustrates a cross sectional view of a strand 932 used to form an outer layer of a cable assembly, in accordance with some described embodiments. As shown, strand 932 includes a diameter 978. Diameter 978 is approximately in the range of 0.1 to 1 millimeters. Also, strand 932 is shown as generally having a circular cross section. However, other cross sectional shapes, including oblong shapes due strand being stretched and under tension, are possible.

FIG. 13 illustrates a plan view of an outer layer 1006 of a cable assembly, showing additional relationships of the strands of the outer layer 1006, in accordance with some described embodiments. As shown, outer layer 1006 includes a strand 1032 positioned an angle $\alpha$ relative to an imaginary vertical line 1082. Angle $\alpha$ may be approximately in the rage of 15 to 60 degrees. Also, the strands (including strand 1032) of outer layer 1006 provide a substantial cover or jacket for a cable assembly. However, some gaps, or openings, between adjacent strands may be present. For example, a gap 1084 between (and defined by) several surrounding strands is shown. Gap 1084 represents an uncovered area of a cable assembly by outer layer 1006, i.e., where no strands of outer layer 1006 are present. Based upon the manufacturing process, outer layer 1006 is designed to provide coverage approximately in the range of 75% to 95%. Additionally, a region 1086 of outer layer 1006 is shown. Within region 1086 (representative of remaining areas of outer layer 1006), the picks per inch ("ppi") is approximately in the range of 10 to 60 ppi.

Figure 14:
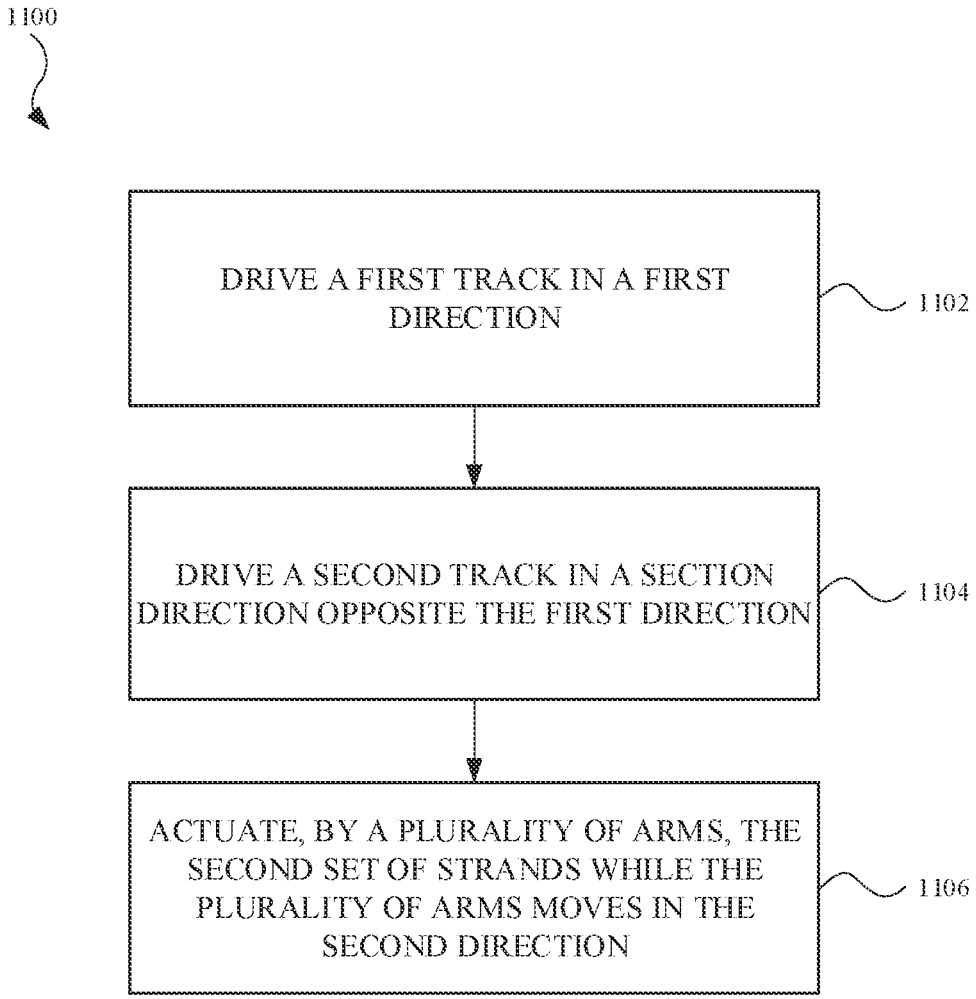
FIG. 14 illustrates a flowchart showing a method for manufacturing a cable assembly, in accordance with some described embodiments.

FIG. 14 illustrates a flowchart 1100 showing a method for manufacturing a cable assembly, in accordance with some described embodiments. The method shown and described in flowchart 1100 can be implement by machine tools described herein. In particular, flowchart 1100 shows and describes a manner in which machine tools can braid/weave an outer layer for cable assemblies.

In step 1102, a first track is driven in a first direction. The first track can carry a first set of strands. For example, the first track may include several carrier positions designed to hold one or more bobbins. Each bobbin may include a strand of material used to form an outer layer of the cable assembly. As a non-limiting example, the strand of material may include yarn.

In step 1104, a second track is driven in a second direction opposite the first direction. The first and second directions may include opposing rotational directions. Similar to the first track, the second track can also carry a second set of strands with material similar to that of the first set of strands. While the material may be similar, other appearances (e.g., color) can differ. Alternatively, the material, including the make-up, can differ on different tracks and/or on different bobbins.

In step 1106, several arms actuate the second set of strands while the arms moves in the second direction. For example, in some embodiments, the arms (one for each bobbin on the second track) can guide the second set of strands in accordance with a periodic pattern, which may include a (repeating) sinusoidal pattern. The machine tool may include a third track that defines the periodic pattern. In this manner, while the second set of strands and the arms move in the second direction, the arms further guide the material (i.e., strand) along the periodic pattern. When the first track is inside the second track (or alternatively put, the second track is outside the first track), the arm can guide the strands toward (including inside of) the bobbins on the first track, as well as guide the strands away from (including outside of) the bobbins on the first track. Alternative to the third track, each arm can be driven by a motor (e.g., servo motor) in accordance with the periodic pattern.

Figure 15:
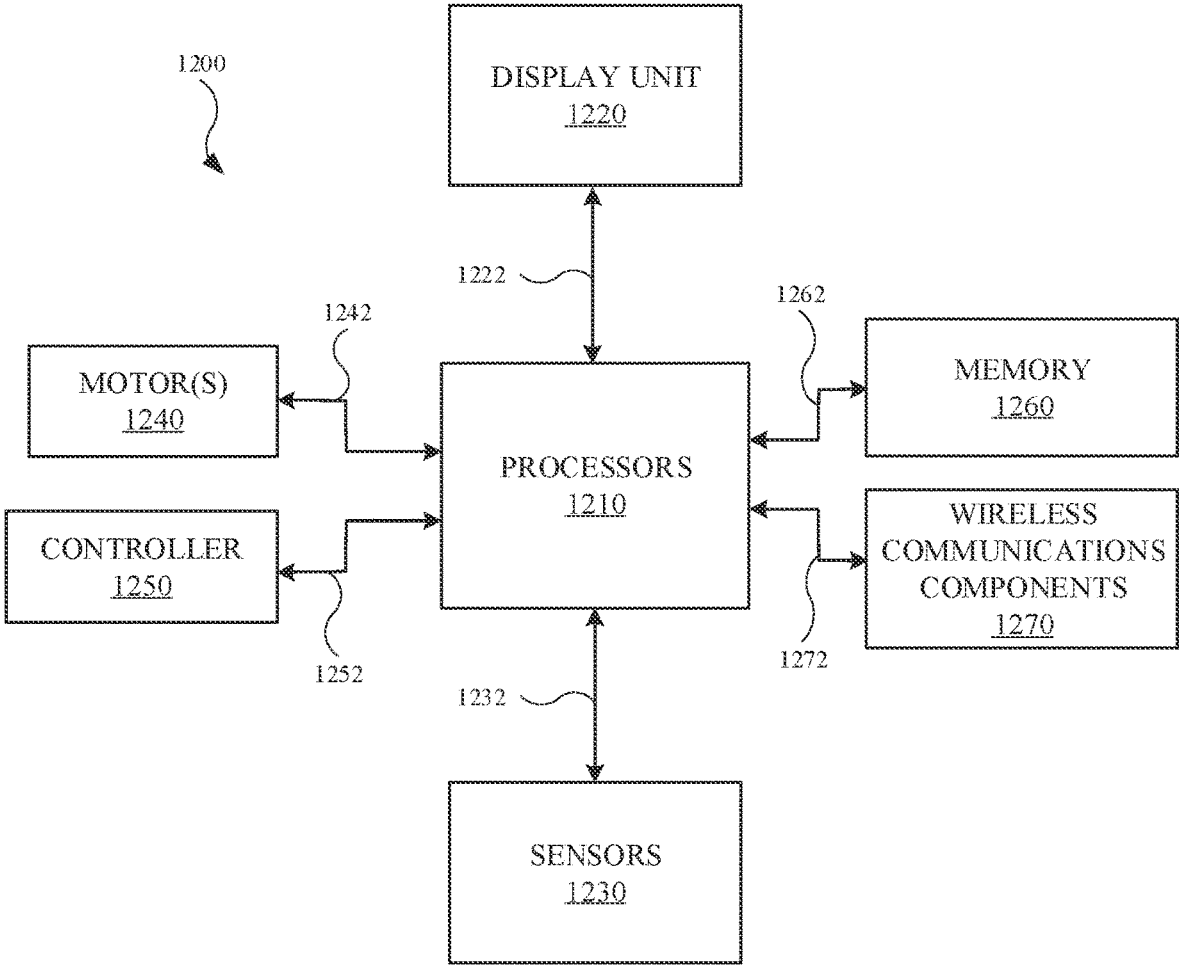
FIG. 15 illustrates a block diagram of a machine tool used to form an outer layer for a cable assembly, in accordance with some described embodiments.

FIG. 15 illustrates a block diagram 1200 of a machine tool used to form an outer layer for a cable assembly, in accordance with some described embodiments. The features in the machine tool may be present in other machine tools described herein. The machine tool may include one or more processors 1210 for executing functions of the machine tool. One or more processors 1210 can refer to at least one of a central processing unit (CPU) and at least one microcontroller for performing dedicated functions. Also, one or more processors 1210 can refer to application specific integrated circuits.

According to some embodiments, the machine tool can include a display unit 1220. Display unit 1220 is capable of presenting a user interface that includes icons (representing software applications), textual images, and/or motion images. In some examples, each icon can be associated with a respective function that can be executed by one or more processors 1210. In some cases, display unit 1220 includes a display layer (not illustrated), which can include a liquid-crystal display (LCD), light-emitting diode display (LED), or the like. According to some embodiments, display unit 1220 includes a touch input detection component and/or a force detection component that can be configured to detect changes in an electrical parameter (e.g., electrical capacitance value) when the user's appendage (acting as a capacitor) comes into proximity with display unit 1220 (or in contact with a transparent layer that covers the display unit 1220). Display unit 1220 is connected to the one or more processors 1210 via one or more connection cables 1222.

According to some embodiments, the machine tool can include one or more sensors 1230 capable of providing an input to one or more processors 1210 of the machine tool. One or more sensors 1230 may include proximity sensors (e.g., inductive proximity sensors, capacitive sensors, photoelectric sensors, or the like) used to determine the position of one or more bobbins and/or one or more arms of the machine tool. One or more sensors 1230 is/are connected to one or more processors 1210 via one or more connection cables 1232.

According to some embodiments, machine tool can include one or more motors 1240. In some cases, one or more motors 1240 includes alternating current ("AC") motors, direct current ("DC") motors, and/or servo motors. The one or more motors 1240 can drive the tracks that carry the bobbins. Additionally, some of the one or motors 1240 can drive the arms in accordance with a periodic pattern. When one or more one or more motors 1240 are used, one or more motors 1240 is/are connected to one or more processors 1210 via one or more connection cables 1242.

According to some embodiments, machine tool can include a controller 1250 that is capable of providing commands to one or more motors 1240. As an example, controller 1250 may include a programmable logic controller. Controller 1250 can be connected to one or more processors 1210 via one or more connection cables 1252.

According to some embodiments, machine tool can include memory 1260, which can include a single disk or multiple disks (e.g., hard drives), and includes a storage management module that manages one or more partitions within memory 1260. In some cases, memory 1260 can include flash memory, semiconductor (solid state) memory or the like. Memory 1260 can also include a Random Access Memory ("RAM") and a Read-Only Memory ("ROM"). The ROM can store programs, utilities or processes to be executed in a non-volatile manner. The RAM can provide volatile data storage, and stores instructions related to the operation of machine tool. In some embodiments, memory 1260 refers to a non-transitory computer readable medium. One or more processors 1210 can also be used to execute software applications. In some embodiments, a data bus 1262 can facilitate data transfer between memory 1260 and one or more processors 1210.

According to some embodiments, machine tool can include wireless communications components 1270. A network/bus interface 1272 can couple wireless communications components 1270 to one or more processors 1210. Wireless communications components 1270 can communicate with other electronic devices via any number of wireless communication protocols, including at least one of a global network (e.g., the Internet), a wide area network, a local area network, a wireless personal area network (WPAN), or the like. In some examples, wireless communications components 1270 can communicate using NFC protocol, BLUETOOTH® protocol, or WIFI® protocol.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a non-transitory computer readable medium. The non-transitory computer readable medium is any data storage device that can store data which can thereafter be read by a computer system. Examples of the non-transitory computer readable medium include read-only memory, random-access memory, CD-ROMs, HDDs, DVDs, magnetic tape, and optical data storage devices. The non-transitory computer readable medium can also be distributed over network-coupled computer systems so that the computer readable code is stored and executed in a distributed fashion.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

What is claimed is:

1. A cable assembly, comprising:

a first connector;

a second connector;

a cord extending between the first connector and the second connector, the cord configured to provide power and data transmission from the first connector to the second connector, the cord comprising:

an outer layer, the outer layer comprising:

a first set of strands, wherein each strand of the first set of strands comprises a circular cross section, a second set of strands adjacent to the first set of strands, and a third set of strands weaved with the first set of strands and the second set of strands;

an insulated wire electrically connected to the first connector and the second connector;

an uninsulated wire electrically connected to the first connector and the second connector, wherein the insulated wire and the uninsulated wire are configured to provide the power and data transmission from the first connector to the second connector; and a fill material between the insulated wire and the uninsulated wire, wherein the fill material contacts the insulated wire and the uninsulated wire.

2. The cable assembly of claim 1, wherein the first set of strands and the second set of strands includes yarn.

3. The cable assembly of claim 1, wherein each of the first set of strands, the second set of strands, and the third set of strands includes two strands.

4. The cable assembly of claim 1, wherein each of the first set of strands, the second set of strands, and the third set of strands includes exactly two strands.

5. The cable assembly of claim 1, wherein the first set of strands is parallel with respect to the second set of strands.

6. The cable assembly of claim 1, wherein the outer layer defines an exterior of the cord.

7. The cable assembly of claim 1, wherein:

the first connector is configured to plug into an electronic device, and the second connector is configured to plug into a power adapter.

8. A cable assembly, comprising:

a first connector;

a second connector; and a cord extending between the first connector and the second connector, the cord comprising an outer layer, the outer layer comprising:

a first pair of strands, a second pair of strands adjacent to the first pair of strands, and a third of pair strands, wherein the third pair of strands passes over the first pair of strands and passes under the second pair of strands;

a plurality of insulated wires electrically connected to the first connector and the second connector;

a plurality of uninsulated wires electrically connected to the first connector and the second connector, wherein the plurality of insulated wires and the plurality of uninsulated wires are configured to provide power and data transmission from the first connector to the second connector; and a fill material between the plurality of insulated wires and the plurality of uninsulated wires, wherein the fill material contacts i) each insulated wire of the plurality of insulated wires and ii) each uninsulated wire of the plurality of uninsulated wires.

9. The cable assembly of claim 8, wherein the first pair of strands is parallel with respect to the second pair of strands.

10. The cable assembly of claim 8, wherein at least one of the first pair of strands, the second pair of strands, and the third pair of strands comprises yarn.

11. The cable assembly of claim 8, wherein:

the first pair of strands comprises two strands, and the second pair of strands comprises two strands.

12. The cable assembly of claim 11, wherein the third pair of strands comprises two strands.

13. A cable assembly, comprising:

a connector;

a cord connected to the connector, the cord comprising an outer layer, the outer layer comprising:

a first set of strands, a second set of strands parallel to the first set of strands, and a third of set strands, wherein the third set of strands passes over the first set of strands and passes under the second set of strands;

a plurality of insulated wires electrically connected to the connector;

a plurality of uninsulated wires electrically connected to the connector; and a fill material between, and in contact with, the plurality of insulated wires and the plurality of uninsulated wires.

14. The cable assembly of claim 13, wherein the first set of strands is adjacent to the second set of strands.

15. The cable assembly of claim 13, wherein at least one of the first set of strands, the second set of strands, and the third set of strands comprises yarn.

16. The cable assembly of claim 13, wherein:

the first set of strands comprises two strands, and the second set of strands comprises two strands.

17. The cable assembly of claim 16, wherein the third set of strands comprises two strands.

* * * * *